United States Patent [19]

Pong et al.

[11] 4,398,654

[45] Aug. 16, 1983

[54] AEROSOL DISPENSING SYSTEM

[75] Inventors: Richard G. S. Pong, Passaic Park; Arun Nandagiri, Dover; Oleh M. Bilynskyj, East Hanover; LeRoy Hunter, Randolph, all of N.J.

[73] Assignee: American Cyanamid Company, Stamford, Conn.

[21] Appl. No.: 136,206

[22] Filed: Jan. 4, 1980

Related U.S. Application Data

[63] Continuation-in-part of Ser. No. 84,687, Oct. 15, 1979, abandoned, which is a continuation-in-part of Ser. No. 973,261, Dec. 22, 1978, abandoned.

[51] Int. Cl.[3] ..... B65D 83/00

[52] U.S. Cl. ..... 222/402.1; 222/402.18; 222/464; 55/159

[58] Field of Search ..... 222/189, 211, 464, 402.1, 222/402.18, 402.2; 239/337, 340, 372; 55/159

[56] References Cited

U.S. PATENT DOCUMENTS

| | | | |
|---|---|---|---|
| 2,681,252 | 6/1954 | Tuttle | 239/337 |
| 2,995,278 | 8/1961 | Clapp | 239/337 |
| 3,523,408 | 8/1970 | Rosenberg | 55/159 |

*Primary Examiner*—H. Grant Skaggs
*Attorney, Agent, or Firm*—Charles J. Fickey

[57] ABSTRACT

An aerosol dispensing device for a three phase system which dispenses the product in a uniform fine mist at a high spray rate. The aerosol device generally comprises an aqueous liquid phase, a non-aqueous liquified propellant forming a liquid phase and a vapor phase of the propellant, and diptube which is impervious to the aqueous phase, and the vapor phase, but passes the non-aqueous liquid phase. The aqueous phase passes through the lower end of the diptube.

6 Claims, 7 Drawing Figures

AEROSOL DISPENSING SYSTEM

This application is a continuation-in-part of previously filed application Ser. No. 84,687, filed Oct. 15, 1979, which was a continuation-in-part of Ser. No. 973,261, filed Dec. 22, 1978, both now abandoned.

The present invention relates generally to aerosol devices to dispense two immiscible liquid phases in a three-phase system as a fine, dry spray. More particularly, it relates to a novel valve/diptube assembly for dispensing two immiscible liquid phases in a three-phase system, one of which is a gaseous propellant phase.

It will be understood that a wide variety of substances have been dispensed from pressurized containers under the influence of a gaseous propellant. These systems are the well-known aerosol products, which have used fluorocarbon or hydrocarbons (condensed gases) or compressed gases, such as carbon dioxide. Generally, in these systems, the material to be dispensed, if a solid, is suspended in the liquified propellant (for example, antiperspirant compositions); if a liquid, either a single liquid phase is formed by dissolution of the liquified propellant therein and the product dispensed by the propellant vapor, or the liquid may be dispensed by a compressed gas, such as $CO_2$. Usually a valved eduction tube, open at the bottom, provides for the propellant to force the material to be dispensed up the eduction tube and out of the container. These systems are known as two-phase systems—phase I being an upper layer of propellant gas and phase II being a liquid or a solid suspended in a liquid.

If, however, the product to be dispensed is of the nature of two immisicible liquids, for example, an aqueous solution and a liquified hydrocarbon propellant, difficulty is encountered. Such systems are three-phase systems and conventional valve/diptube assemblies are incapable of handling them. In the three-phase system, phase I is either a compressed gas or a voporized propellant, such as hydrocarbon gas; phases II and III are immiscible liquid phases, one of which may be a liquified propellant. An example of a three-phase system is an aqueous solution of a product dispensed using a hydrocarbon propellant wherein phase II is liquified hydrocarbon propellant and phase I is gaseous hydrocarbon propellant.

Conventionally, an aerosol valve is fitted with a diptube (eduction tube) extending to a point near the bottom of the container and into the product to be dispensed. The product flows under influence of the propellant up through the eduction tube into the valve housing and is dispensed through the valve bottom. A vapor tap, which usually opens into the body of the valve to mix gaseous propellant with the product stream, may be included in the device.

Technology is available today to formulate aerosol products, including certain hair sprays, as solutions in water, or in water-alcohol solutions in which hydrocarbon propellants are insoluble. The problem with such three-phase systems is in their delivery by aerosol techniques. One technique for handling such systems is described in U.S. Pat. No. 3,260,421.

In accordance with the present invention, aerosol means are provided for dispensing two immiscible liquid phases in a three-phase system, which comprises a valve means and a diptube means adapted to draw off simultaneously both liquid phases to the valve means; said diptube means extending to a point near the bottom of the aerosol container and comprising means preferentially permeable or permeable only to a first liquid phase, and means preferentially permeable or permeable only to a second liquid phase, both means being substantially impermeable to the gaseous propellant.

The means provided by the present invention may comprise various adaptations of the aforementioned principle, as shown in the accompanying drawings.

Accordingly, it is an object of the present invention to provide an improved pressurized aerosol package and delivery system for a three-phase composition.

Another object of the invention is to provide a valve and diptube device to dispense, at a uniform rate, a fine mist spray of a product which is insoluble in and immiscible with the propellant.

Another object of the invention is to provide a valve and diptube means to dispense, at a uniform rate a fine mist spray of a water-based product using a water-immiscible hydrocarbon propellant.

These and other objects of the invention will become apparent as the description thereof proceeds.

Figure 1:
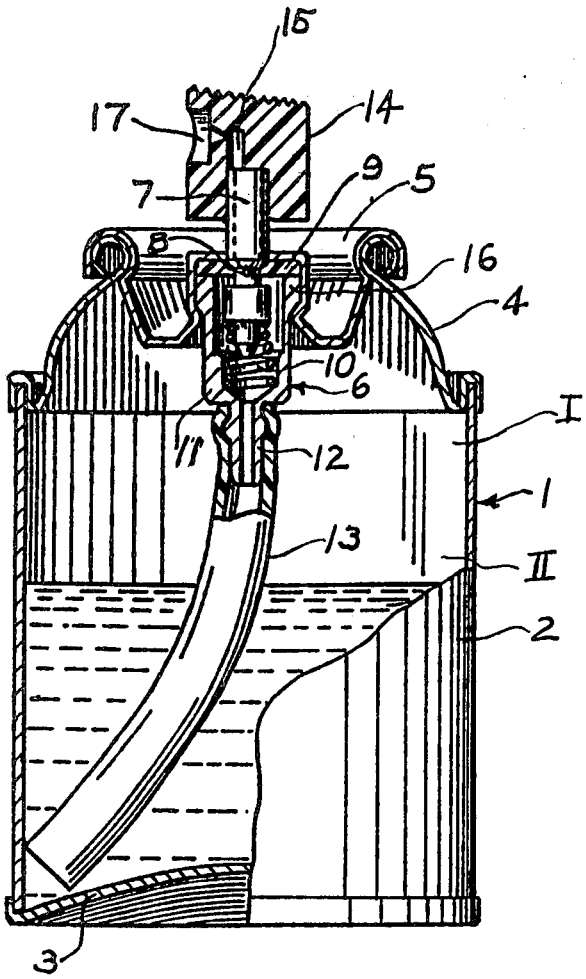
FIG. 1 is a side-sectional, diagramatic view of the prior art pressurized aerosol container for use with two-phase systems.

Referring to FIG. 1, a conventional two phase aerosol system is shown having container 1 with body 2, bottom 3, collar 4 and top 5. A valve member 6 fits into top 5. The contents of container 1 are divided into two phases, an upper phase I and a lower phase II. Phase II consists of a liquid propellant which is a vapor under atmosphere pressure and in which the product to be dispensed in dissolved or admixed. Phase I is vaporized propellant. Valve member 6 comprises a hollow stem with the valve 8 normally seated against gasket 9 by means of spring 10. Surrounding the valve is a housing 11 with a tailpiece 12 to which flexible diptube 13 is attached. The valve stem 7 has actuator or head 14 mounted thereon with passageway 15 therethrough. When actuated by pressing down head 14, the valve 8 is moved downward to open into interior cavity 16 of valve body 11. Since vapor phase I and liquid phase II are under superatmospheric pressure, fluid is forced up diptube 13 into passageway 15. The liquid becomes vaporized and leaves head orifice 17 as a fine spray.

Figure 2:
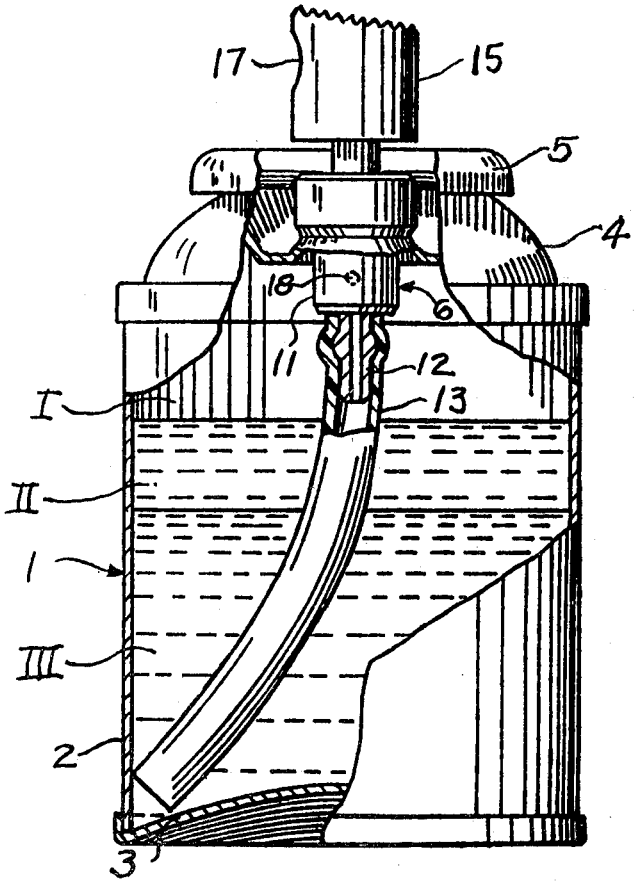
FIG. 2 is a side-sectional, diagramatic view of prior art pressurized aerosol container for use with a three-phase system.

In FIG. 2, a conventional aerosol container 1 of the same type as FIG. 1 is shown having a three phase system, in which for example, phase I is vaporized propellant, phase II is liquified propellant and phase III is a liquid product not miscible with the propellant and which is heavier than the liquid propellant. For example, the propellant may be a hydrocarbon, e.g. butane and the product phase may be a water-based hair spray. When actuator head 14 is depressed, phase III liquid rises up tube 13 into valve 6, but leaves orifice 17 as a stream or poorly dispersed spray rather than a fine mist since there is no vaporizable propellant admixed with it. In order to form a better mist spray, a tap 18 on valve body 11 has been added to admit vapor phase I to the body cavity 16 where it admixes with product liquid phase III giving a more mist-like spray from orifice 17. Such a system, however, has the disadvantage of an extremely low spray rate since the vapor occupies most of the volume of the valve body.

We have now found that this disadvantage may be overcome by the use of the valve assembly shown in FIGS. 3 to 7. In the present device, the high spray rates and desired spray characteristics are obtained by mixing the liquid phase II with the product phase III which are mixed in the housing of the valve.

It has been proposed to admix a liquified phase with a non-miscible phase in the prior art such as in U.S. Pat. Nos. 3,113,698; 3,260,421; or 3,272,402.

The problems encountered with these systems were that they were complex and expensive. Our inventive valve system accomplishes the admixing of phases II and III by a different principle and by means of a much simpler device.

Figure 3:
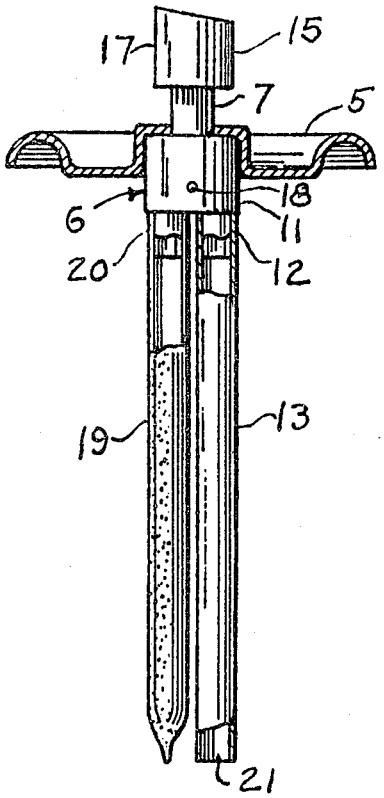
FIGS. 3 to 7 represent several alternative constructions for the valve and diptube assemblies of the present invention.

In FIG. 3 is illustrated an example of a valve and diptube assembly of the present invention.

In addition to all the conventional parts, as in the valve of FIG. 2, this new valve will have an additional diptube 19 which fits on housing 11 at a second tailpiece 20. Diptube 19, closed at the lower end extends to the bottom of container 1. The purpose of this second diptube 19 is to draw liquid phase II into the valve body. Its material of construction is such that it will not allow vapor phase I to permeate through and would preferentially allow liquid phase II to travel through the tube. A silicone treated filter paper can be used. When actuator head 15 of aerosol valve 6 is depressed, the liquid phase II, e.g. a hydrocarbon such as butane travels through permeable tube 19 while the product phase III, e.g. a water-based concentrate goes up the conventional tube 13 which is open at its lower end 21. The phases II and III mix within housing 11 and discharge through the head orifice 17.

As a product is used up, the vapor phase area I, increases. However, since tube 19 is substantially impermeable and does not allow gaseous phase I to pass through, it does not affect the relative use up of the two liquid phases II and III. This results in a fine uniform spray which remains constant throughout the life of the can. A vapor tap 18 can be added optionally to admit phase I vapor to aid in draining phases II and III when the unit is not operating. This draining is desirable for optimum performance so that a burst of liquid propellant is not obtained at any time. The function described above is unlike the use of conventional vapor tap described in the prior art when vapor is admitted to enhance mixing. Tube 19 may also be a borosilicate glass filter tube (Balstron Filter Products). This consists of borosilicate glass fibers bonded together with a fluorocarbon cement.

It will be understood that tube 19 can be fabricated to be preferentailly permeable to liquid phase II and may pass some of the vapor phase through if desired.

Figure 4:
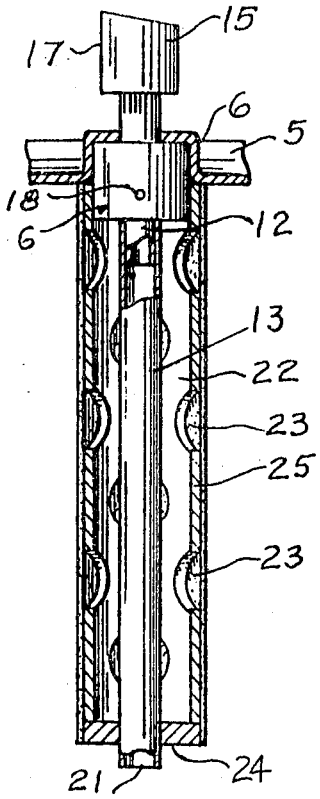

An alternative construction is shown in FIG. 4. Valve body 6 has a tailpiece 12 and diptube 13. A metal tube 22 having a plurality of perforations 23 is fitted to valve body 11 and surrounds diptube 13. Tube 22 is closed at its lower end by means impermeable to both phases II and III, such as a stopper 24 through which diptube 13 extends, opening into phase III. Tube 22 is wrapped with a material 25 which is permeable to phase II but not phase III, such as a silicone treated filter paper and communicates with valve 6 through propellant tap orifice 20. Actuation of head 15 causes phase III liquid product to enter orifice 21 to diptube 13 and travel upward to valve 6. Phase II liquid propellant permeates layer 25 and passes through perforations 23 into the interior of tube 22 traveling upward to propellant orifice 20 where it enters the body and admixes with phase III.

Figure 5:
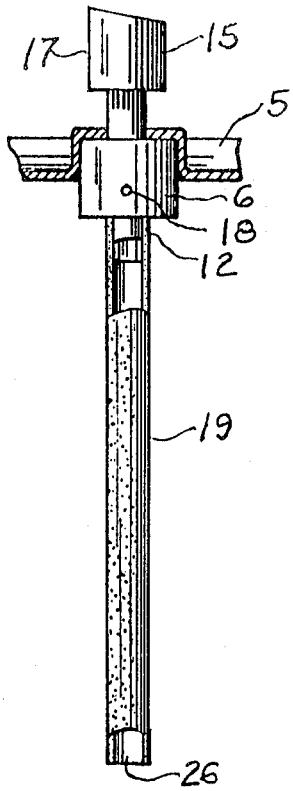

In FIG. 5, a single diptube 19 permeable only to liquid phase II and open at the lower end is attached to tailpiece 12 of valve 6. In this embodiment, the fluid phase III enters the tube through opening 26 at the lower end of tube 19, while liquid propellant phase II permeates the tube walls, both phases admixing in tube 19 and also within valve 6.

The permeable diptube may be a poromeric plastic, such as polystyrene, polyethylene, polypropylene, nylon, polycarbonates, teflon, polyvinylchloride. These poromeric materials are characterized by having multidirectional pores throughout the plastic mass. The pore size may vary from about 0.1 to 30 microns and larger and the pore density, the measure of pores per unit area, typically may be 70 percent, but may be lower or higher. The pore size desired will be dependent on a number of factors such as the internal diameter of the tube, the viscosity of the fluid concentrate. In one particular application a tube having an internal diameter of 1/16 inch was used with a hair spray concentrate having a viscosity of about 7 centistokes. In this instance, the desired pore size is from 1 to 5 microns and the pore density is from about 50 to 70 percent.

The poromeric tube may be prepared by a number of different methods.

In one method, the tube is made by casting of a polymer solution. A solution of polymer in which the compatibility of the solute and solvent is highly temperature dependent is cast or extruded. The solvent separates from the solute to form globules suspended in a polymer - solvent matrix. Removal of the solvent yields a porous material. Pore size is determined by the solution behavior of the components used and the rate of cooling of the solution and ranges from 0.1 microns to 11 microns.

In another method, the tube is made by sintering of plastic beads in molds. Beads of plastic are rounded (made spherical) and sorted for size. The pore size is determined by the bead size and typically ranges from 10 microns to 30 microns and larger with normal techniques but can be made down to 0.2 microns with special techniques.

A third method for making the diptube is by extrusion of a plastic with starch or salt suspended within. The starch or salt is removed by extraction in a hot bath. The starch requires hydrolysis to sugar by including acid in the extraction process. The size of the pores produced is dependent on the size of the salt or starch particles used and ranges from 10 microns downward. A pore density of 70 percent is obtained.

Figure 6:
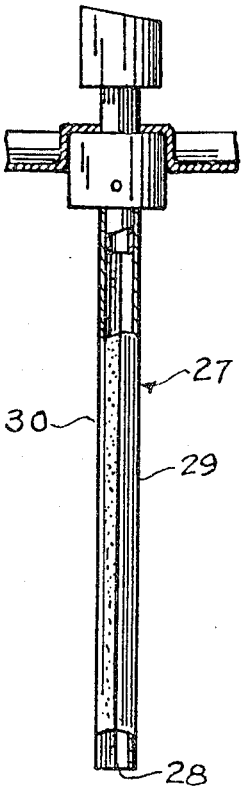

In FIG. 6, a single diptube 27 is provided which is open at the bottom 28 and has one side 29 impermeable to phase II and phase III and side 30 permeable to phase II but impermeable to phase III. The liquid product phase III enters tube 27 through orifice 28, and liquid propellant phase II enters the tube through permeable wall 30 of the tube.

Figure 7:
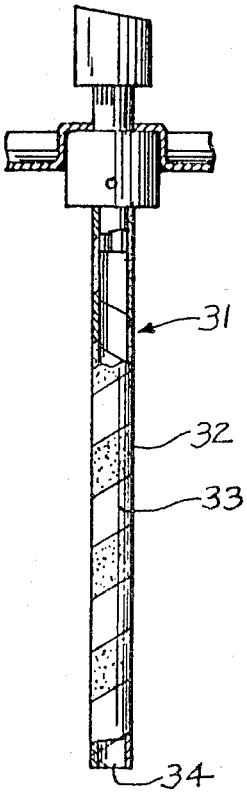

FIG. 7 is similar to the embodiment of FIG. 6 except that the diptube 31 consists of alternating spiral bands of a material 32 which is permeable to phase II and material 33 not permeable to either phase II or III. Phase III enters through the open end 34 of tube 31, and phase II propellant enters through material 32.

Following are Examples of formulations which may be dispensed in the inventive container and valve assembly of the present invention.

EXAMPLE I

Insecticide

| | % w/w |
|---|---|
| Pyrethrins | 0.25 |
| Piperonyl Butoxide | 1.25 |
| Fragrance | 0.20 |
| Petroleum Distillate | 1.25 |
| Deionized Water | 67.05 |
| Isobutane | 30.00 |
| | 100.00 |

EXAMPLE II

Space Deodorant

| | |
|---|---|
| Perfume | 1.50 |
| Deionized Water | 73.50 |
| Isobutane | 25.00 |
| | 100.00 |

EXAMPLE III

Antiperspirant

| | % w/w |
|---|---|
| Aluminum Chlorhydrol (Water Soluble) | 15.00 |
| Perfume | 0.50 |
| Deionized Water | 44.50 |
| Isobutane | 25.00 |
| Alcohol 190 Proof | 15.00 |
| | 100.00 |

EXAMPLE IV

Deodorant

| | |
|---|---|
| Alcohol 190 Proof | 20.00 |
| Perfume | 1.50 |
| Deionized Water | 53.50 |
| Isobutane | 25.00 |
| | 100.00 |

EXAMPLE V

Hair Spray

| | |
|---|---|
| Alcohol 190 Proof | 43.72 |
| Gantrez ES 225 | 6.00 |
| A.M.P. | 0.13 |
| Deionized Water | 25.00 |
| Perfume | 0.15 |
| Isobutane | 25.00 |
| | 100.00 |

EXAMPLE VI

Hair Spray $CO_2$

| | |
|---|---|
| Alcohol SD40 200 Proof | q.s. |
| Gantrez ES 225 | 6.00 |
| AMP | 0.13 |
| Perfume | 0.15 |
| $CO_2$ to 100 psig | 5.00 |
| | 100.00 |

We claim:

1. Valve and diptube means for a pressurized aerosol container, containing two immiscible liquid phases and a vapor phase therein; said valve and diptube means adapted to simultaneously draw off both liquid phases to said valve means; said diptube means being attached to said valve means at its upper end and having the lower end extending to a point near the bottom of said container, said diptube means comprising a first diptube permeable substantially only to the upper of said liquid phases and connected to an orifice in said valve means and closed at its lower end; and a second diptube connected to a second orifice in said valve which is open at its lower end and substantially impermeable to said liquid and vapor phases.

2. Valve and diptube means for a pressurized aerosol container, containing two immiscible liquid phases and a vapor phase therein; said valve and diptube means adapted to simultaneously draw off both liquid phases to said valve menas; said diptube means being attached to said valve means at its upper end and having the lower end extending to a point near the bottom of said container, said diptube means comprising, a first impermeable diptube connected to an opening to said valve means and being open at its lower end and a second diptube comprising a sleeve permeable substantially only to the upper of said liquid phases surrounding said impermeable diptube and being closed at its lower end, said sleeve being connected to said valve means, and having an opening from the area within said permeable diptube sleeve to said valve means.

3. Valve and diptube means for a pressurized aerosol container, containing a hydroalcoholic liquid phase, a liquified hydrocarbon propellant phase and a vapor hydrocarbon phase therein; said valve and diptube means adapted to simultaneously draw off both liquid phases to said valve means; said diptube means being attached to said valve means at its upper end and having the lower end extending to a point near the bottom of said container, said diptube means comprising a single tube connected to an orifice in said valve means and open at its lower end, said diptube being permeable substantially only to said liquified propellant.

4. Valve and diptube means for a pressurized aerosol container, containing a hydroalcoholic liquid solution phase, a liquified hydrocarbon propellant phase and a vapor hydrocarbon phase therein; said valve and diptube means adapted to simultaneously draw off both liquid phases to said valve means; said diptube means being attached to said valve means at its upper end and having the lower end extending to a point near the bottom of said container, said diptube means comprising a single diptube wherein a part of said diptube wall is substantially impermeable to said vapor, liquified propellant phase and solution phase and a part of said wall is permeable substantially only to said liquified propellant phase.

5. Valve and diptube means for a pressurized aerosol container, containing two immiscible liquid phases and a vapor phase therein; said valve and diptube means adapted to simultaneously draw off both liquid phases to said valve means; said diptube means being attached to said valve means at its upper end and having the lower end extending to a point near the bottom of said container, said diptube means comprising a single tube connected to an orifice in said valve means and open at its lower end, said diptube being permeable substantially only to the upper of said liquid phases.

6. Valve and diptube means for a pressurized aerosol container, containing two immiscible liquid phases and a vapor phase therein; said valve and diptube means adapted to simultaneously draw off both liquid phases to said valve means; said diptube means being attached to said valve means at its upper end and being open at its lower end, and having the lower end extending to a point near the bottom of said container, said diptube means comprising a single diptube wherein a part of said diptube wall is substantially impermeable to said vapor, and liquid phases, and a part of said wall is permeable substantially only to the upper of said liquid phases.

* * * * *